US005620133A

United States Patent [19]

Isserstedt

[11] Patent Number: 5,620,133

[45] **Date of Patent: *Apr. 15, 1997**

[54] STORAGE AND FILING DEVICE

[75] Inventor: Robert K. Isserstedt, London, England

[73] Assignees: Vertago Investments Limited, Douglas, Isle of Man; Bank of Bermuda, Virgin Islands (Br.)

[ * ] Notice: The portion of the term of this patent subsequent to Nov. 17, 2009, has been disclaimed.

[21] Appl. No.: 302,244

[22] Filed: Sep. 8, 1994

Related U.S. Application Data

[63] Continuation of Ser. No. 977,014, Nov. 16, 1992, abandoned, which is a continuation-in-part of Ser. No. 301,332, Jan. 25, 1989, Pat. No. 5,163,606.

[30] Foreign Application Priority Data

Jan. 25, 1988 [GB] United Kingdom ..... 8801568

[51] Int. Cl.[6] ..... B65D 27/02

[52] U.S. Cl. ..... 229/67.1; 229/67.2; 383/22; 383/23; 383/66; 383/107

[58] Field of Search ..... 229/1.5 R, 67.1, 229/67.2, 67.4; 383/22, 23, 63, 64, 65, 66, 107, 903, 119; 312/184; 40/359

[56] References Cited

U.S. PATENT DOCUMENTS

| | | | |
|---|---|---|---|
| 259,410 | 6/1882 | Marmaduke . | |
| 916,206 | 3/1909 | Shedd . | |
| 1,217,013 | 2/1917 | Killingsworth . | |
| 2,807,265 | 9/1957 | Oliva et al. | 383/66 X |
| 2,816,379 | 12/1957 | Ensor . | |
| 3,120,297 | 2/1964 | Riley . | |
| 3,121,966 | 2/1964 | Upton . | |
| 3,368,600 | 2/1968 | Coniker | 383/107 X |
| 3,676,942 | 7/1972 | Elrod . | |
| 4,365,433 | 12/1982 | Buell . | |
| 4,497,128 | 2/1985 | O'Connor | 312/184 X |
| 4,580,667 | 4/1986 | Herwood | 190/110 |
| 4,589,544 | 5/1986 | Schweinsberg . | |
| 4,706,396 | 11/1987 | Nomura . | |
| 4,793,495 | 12/1988 | Preu | 312/184 X |
| 4,978,055 | 12/1990 | Miller | 383/903 X |
| 5,062,530 | 11/1991 | Mitsuyama | 40/359 X |
| 5,163,606 | 11/1992 | Isserstedt | 229/1.5 R |
| 5,226,734 | 7/1993 | Scott et al. | 383/63 X |

FOREIGN PATENT DOCUMENTS

| | | |
|---|---|---|
| 0126980 | 12/1984 | European Pat. Off. . |
| 1141617 | 12/1962 | Germany . |

*Primary Examiner*—Jes F. Pascua
*Attorney, Agent, or Firm*—Foley & Lardner

[57] ABSTRACT

A portable filing device comprises a bag which can be opened out to be flat, a hook for suspending the bag, a spine extending across the bag, two straps hanging from the ends of the spine, and a series of hanging pouches spaced along the straps. Each pouch is attached to the straps at the ends of its top edge, and has an aperture along its top edge. The pouches are detachable. For transportation, the pouches are gathered into a stack, with the straps forming concertina folds, and the bag is folded around the stack and fastened shut. The device, among other applications, enables travellers to keep papers and belongings in order. A labelling means comprises an elongate stiffly flexible label or label holder which by bowing can be inserted in or removed from an undercut seating.

16 Claims, 5 Drawing Sheets

FIG. 3
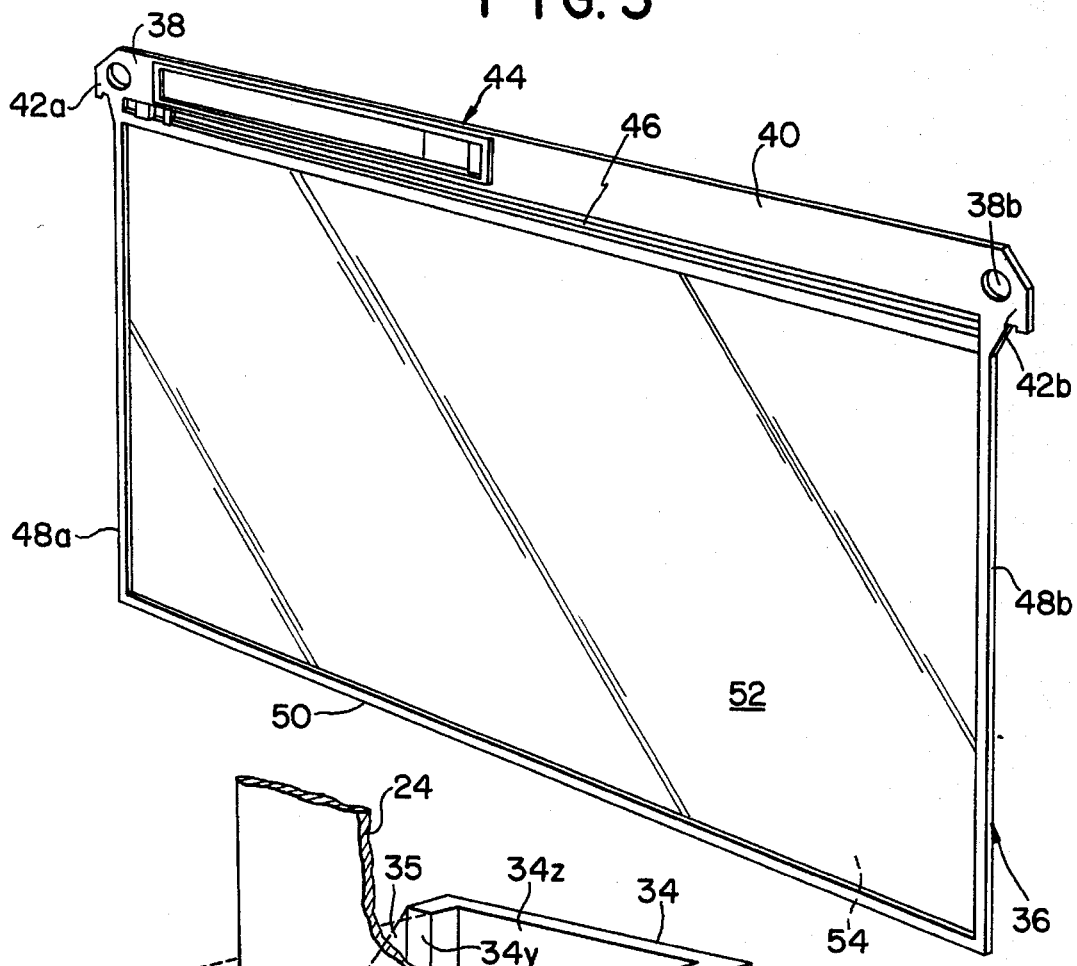
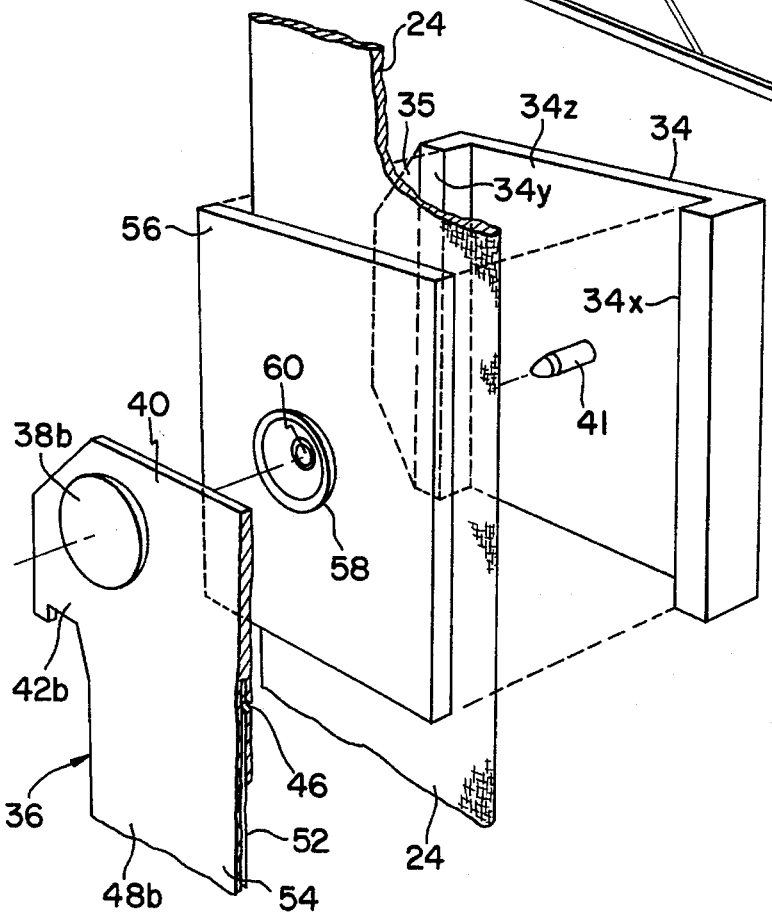
FIG. 6

STORAGE AND FILING DEVICE

This application is a continuation of application Ser. No. 07/977,014, filed Nov. 16, 1992, now abandoned, which in turn is a continuation-in-part of application Ser. No. 07/301,332, filed Jan. 25, 1989, now U.S. Pat. No. 5,163,606.

BACKGROUND OF THE INVENTION

1. Field of the Invention

The present invention relates to storage and filing devices, and particularly to improvements in files and portable storage devices for such files.

2. Description of the Prior Art

A perennial problem for travellers is to keep their belongings organized throughout the journey. This is particularly difficult for business travellers, who may, in the course of a single journey, have to visit several business associates, and/or visit different places and even different countries, and/or deal with numerous different matters, at the same time being severely restricted as to the amount of luggage they can carry, particularly when travelling by air and staying in hotels. Using conventional luggage, briefcases, and the like, it can be extremely difficult to keep business papers and other belongings organized throughout a journey, and in particular, to keep things separate from one another so that particular papers or other belongings can be located quickly, and so that individual matters can be dealt with expeditiously during the journey and on return to base.

A conventional briefcase, even if provided with multiple pockets, is inconvenient because the contents of individual pockets are not immediately apparent, and it may well be necessary to unpack the entire contents to locate particular things. Carrying individual separate folders in a suitcase or a briefcase can help, but is not a complete solution, as the individual folders still have to be unpacked from luggage and repacked, possibly many times in the course of a journey, leading to inconvenience and untidiness, and unless the user is exceptionally meticulous, such folders will normally be packed and repacked in varying order in the course of a journey, so that what they contain is not always presented to the traveller in the same order.

Loose-leaf products, for example, "Filofax" (Registered Trade Mark) and similar "organizers", are excellent for storing and presenting information such as dates and notes, but are of little use for organizing things like bills, letters, reports, tickets, currency, and the numerous other pieces of paper and other articles that travellers commonly put in briefcases or pockets.

Consequently, there is a need for a device which will enable the traveller to organize his papers at the beginning of and during a journey, and to maintain that organization and, in particular, the distribution and order of presentation of individual matters throughout the journey, which is capable of being easily carried and occupies little space when in use, for example, in a hotel room.

It is known to provide a storage device with a series of envelopes attached one to the other by connecting means. An example of such a construction is shown in U.S. Pat. No. 4,706,396, issued Nov. 17, 1987.

The bags described in U.S. Pat. No. 4,706,396 are permanently attached to each other. Further, the attachments are short strips extending from the front face of one bag to the rear face of the adjacent offset bag. Such a construction requires that the front and rear faces of the bags be reasonably rigid and that the bag construction be strong in order to transfer the weight of succeeding bags and their contents without otherwise deforming the bags.

SUMMARY OF THE INVENTION

It is an aim of the present invention to provide an improved portable file storage and carrying system, including an improved pouch suspension structure wherein the pouches are not subjected to the weight of succeeding pouches.

It is a further aim of the present invention to provide an improved pouch which can serve as a file for papers as well as for other heavier items such as coins and tools, and which can be used in a portable storage device or be removed from the storage system and handled individually or placed in a conventional file cabinet.

A further aim of the present invention is to provide an improved file labeling system.

According to the invention, the pouch suspension means comprise at least an elongated foldable member or the like separate from the pouches, and the pouches are attached to the elongated foldable member in such a manner that they overlap one with the other.

In a more specific embodiment, the pouches are releasably attached to the foldable member in order to be able to take an individual pouch and its contents to a particular meeting.

A further construction in accordance with the present invention includes a storage and filing device comprising a pouch suspension in the form of at least an elongated foldable member, including rigid components integral with and spaced apart longitudinally of the elongated member and flexible portions of the foldable member extending between the rigid components. A plurality of pouches have top and bottom edges and attachment means near the top edge of each pouch for attaching the pouches to respective components, such that the pouches overlap on the elongated foldable members in an open condition, and the pouches can be stacked one against each other while attached to the components of the foldable members in a closed position.

In a more specific embodiment of the present invention, there is provided a storage cover member, a pair of parallel foldable strap members, each connected at one end to the cover member. Pairs of rigid components are provided, one of each pair on each strap. Corresponding ones of the components are spaced apart on each strap by a flexible portion of the strap providing foldable hinge portions. A plurality of pouches are provided with each pouch including a top edge, a bottom edge and sides, and an opening near the top edge. A relatively stiff suspension bar extends the width of the pouch along or near the top edge and includes, at each end thereof, fastening means for detachably engaging respective components of a selected pair of components. In an open hanging position, the pouches arranged on the straps overlap each other with the top edges thereof exposed. In a closed position, the pouches are stacked, one against each other, with the straps in a concertina arrangement, and within the confines of the cover.

Accordingly, the present invention also resides in labelling means comprising a support provided with a recess having a pair of opposite ends which are undercut, and a labelling member of semi-rigid material having dimensions corresponding to the recess and including opposite end regions matching the said undercuts, whereby the labelling member can be disposed in said recess and retained therein by said end regions engaging in the undercuts, and the labelling member can be removed from and inserted in the recess by bowing or buckling of the labelling member to render its length effectively less than that of the recess.

According to yet another aspect of the present invention, there is provided a storage or filing pouch having an opening in an upper region for access to its interior, and at each side of the pouch in the upper region thereof a single suspension hook, snap or other connecting means.

According to still another aspect of the invention, there is provided a storage or filing pouch having an opening in an upper region for access to the interior of the pouch, and a stiffener extending along an upper edge of the pouch.

BRIEF DESCRIPTION OF THE DRAWINGS

Having thus generally described the nature of the invention, reference will now be made to the accompanying drawings, showing by way of illustration, a preferred embodiment thereof, and in which:

FIG. 3 is a perspective view of a detail of the present invention, and in particular, an embodiment of a pouch;

FIG. 6 is an enlarged fragmentary exploded view of a detail of the present invention;

DESCRIPTION OF THE PREFERRED EMBODIMENTS

Figure 1:
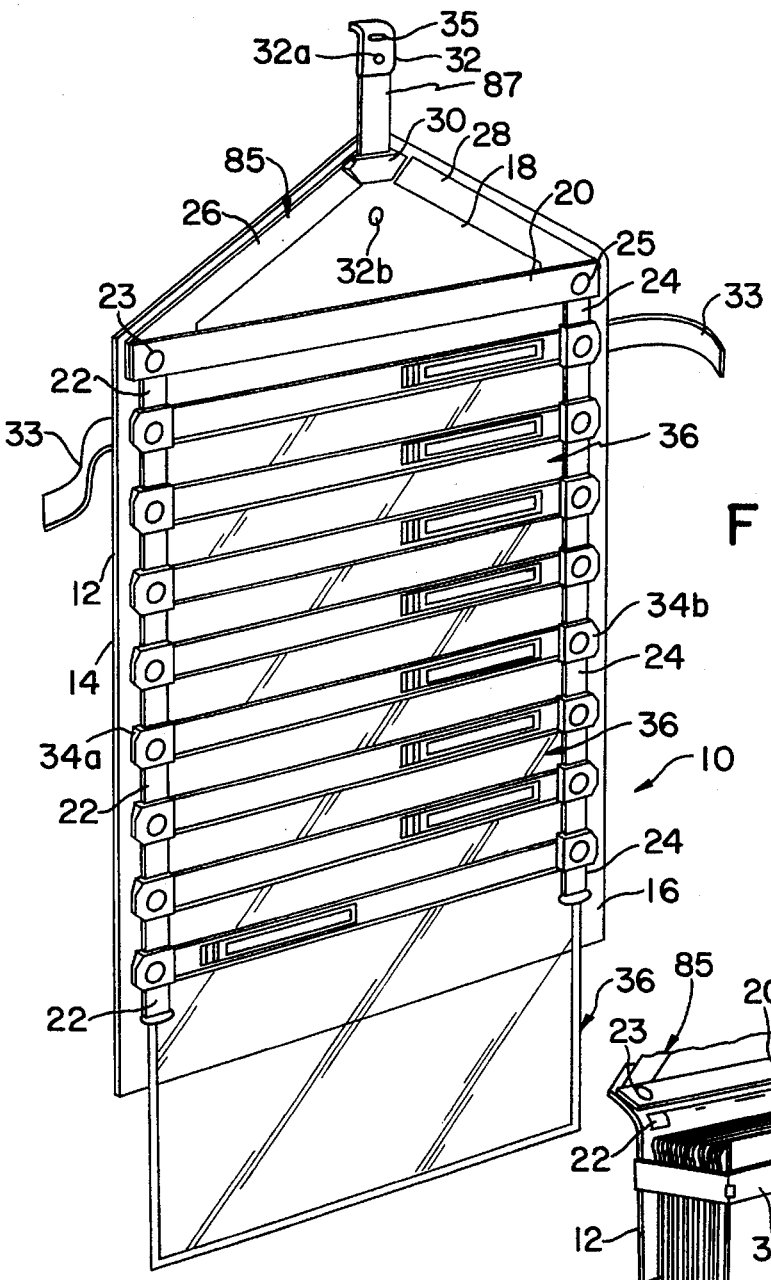
FIG. 1 is a perspective view of a storage and filing device in accordance with the present invention, shown in an open position.
Figure 2:
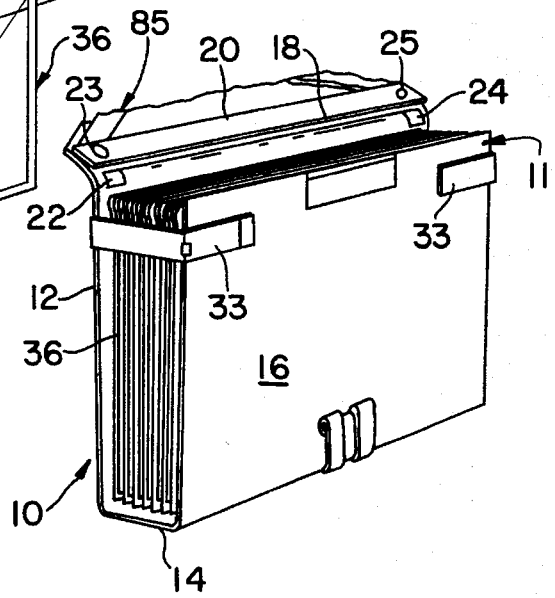
FIG. 2 is a perspective view of the storage and filing device of FIG. 1, shown in a closed position.

FIGS. 1 to 5 illustrate a portable storage and filing device 10, which includes an external bag or case 11. This comprises a main or back panel 12, a bottom panel 14, a front panel 16, and a top flap 18. These parts are so arranged and interconnected that they can be laid or hung in a flat condition as illustrated In FIG. 1, or folded to form a case as shown in FIG. 2 with the bottom panel 14 forward of the back panel 12, and the top flap 18 overlying the front panel 16 and fastened to it. At the hinge or junction between the top flap 18 and back panel 12, there is a rigid spine 20. A handle (not shown) may be fastened so that the bag can be carried.

The panels and flaps of the case may be rigid, semi-rigid, or soft, for example, of canvas, provided with stiffeners at the edges and at the fold lines, as appropriate.

A pair of reinforcing strips 26, 28, for example, of molded plastic or a fabric, are fixed to the inside surface of the top flap 18 and extend from positions near the ends of the spine 20, converging to an apex of the flap 18. The triangular structure made up of spine 20 and strips 26 and 28 will, as described further, provide the hanging structure for the filing system. At the apex of the top flap 18, that is, at the junction of the strips 26, 28, is a plate 30 to which a hook 32 is connected by which the bag, when unfolded, can be hung from a hook, a rail, the edge of a door, or any other convenient suspension point. This hook 32 can be folded and stowed under the top flap 18, when the bag is closed.

In the illustrated embodiment, the back panel has a pair of strips 33 of fastening material such as "Velcro" (Registered Trade Mark), to mate with a corresponding fastening strip or strips provided on the front panel 16 for holding the bag closed. Any other suitable fastening means can be provided, for example, snap fasteners, a slide fastener, straps and buckles, and so on.

Near each end of the spine 20, a respective hanger strap 22, 24 is provided, made, for example, of webbing. Releasable fasteners 23 and 25 are provided to connect straps 22, 24 respectively to the spine 20, so that the latter can be detached from the bag. These fasteners 23, 25, as shown in the drawings, may be conventional metal snap fasteners, or the straps 22, 24 could be stitched directly to the spine 20 or the back panel 12.

The hanging straps could be readily detachable from the spine 20, so that the user can insert longer or shorter straps.

The snap fasteners 23, 25 can be conventional round snap fasteners. However, a minor disadvantage of these is that the straps may tend to swivel outwards when pouches are gathered into a stack. To avoid this, the snap fasteners may have a non-circular, e.g., square or triangular, profile.

Pairs of suspension components 34 are provided at spaced-apart locations on the straps 22 and 24. Each pair of components 34 includes a component 34*a* mounted on the strap 22 and a component 34*b* mounted on strap 24 at a corresponding level. The components, as shown in FIG. 6, include a first panel 34*z* with flanges 34*x* and 34*y*. Centrally of the panel 34*z*, that is, on the rear side thereof, there is provided a pin 41. A back plate 56 is provided with a female opening 60 to engage and lock onto the pin 41. Each component 34*b*, in the case of FIG. 6, is fastened to the strap 24 by punching pin 41 through the strap and fastening the plate 56 between the flanges 34*y* and 34*x* and engaged by the pin 41. Any number of pins 41 may be provided.

Each component 34*a* and 34*b* has a slight, outwardly extending projection referred to by the numeral 35 and a slight finger depression 37. These features allow for better gripping of the components during operation of the device.

As will be described later, the components 34 provide the straps 22 and 24 with intermittent rigid portions separated by the flexible strap portions, allowing the straps, when provided with pouches 36, to fold neatly in a concertina fashion.

Pouch 36, as shown in FIG. 3, for instance, includes a suspension bar 40 having at each end thereof attachment devices 38*a* and 38*b* which will be described later. The suspension bar 40 terminates at each end in hook-shaped projections 42*a* and 42*b*. The pouch 36, as shown in the embodiment of FIG. 3, is made of an injection molded semi-rigid plastics. The suspension bar 40 is molded in one piece with a peripheral frame made up of side members 48*a* and 48*b* and bottom member 50. Panels 52 and 54 form the front and rear of the pouch and are welded to the peripheral frame made up of side members 48*a*, 48*b*, and bottom member 50 as well as the suspension bar 40.

In the present embodiment, the panels 52 and 54 are shown as being transparent. Of course, these may be opaque. The pouch could have other forms and be made of textile material with a plastic or metal suspension bar. Likewise, the pouch 36 could also be of paperboard with gusseted sides and bottoms attached to a suspension bar of relatively stiff material. However, the pouch shown in the present embodiment, which includes a peripheral semi-rigid frame, gives extra protection and strength to the pouch material and the contents thereof and prevents material in the pouch from folding in the case of paper material.

A slit opening 46 is provided in the suspension bar 40 to provide access to the interior of the pouch between the panels 52 and 54. The slit opening may be open or closed by a slide fastener 37. Thus, in a construction, the rear panel 54 is secured to an upper part of the suspension bar 40 above the opening 46, and the front panel 52 of the pouch is welded to a portion of the suspension bar below the opening 36 in the slide fastener 37. The front, lower portion of the suspension bar 40 provides stiffening for the slide fastener 37 when closed so that the weight of the contents in the pouch cannot pull open the pouch opening closed by the fastener. It also stiffens the pouch when it is open, it being able to bow forward to facilitate access to the interior of the pouch.

Figure 4:
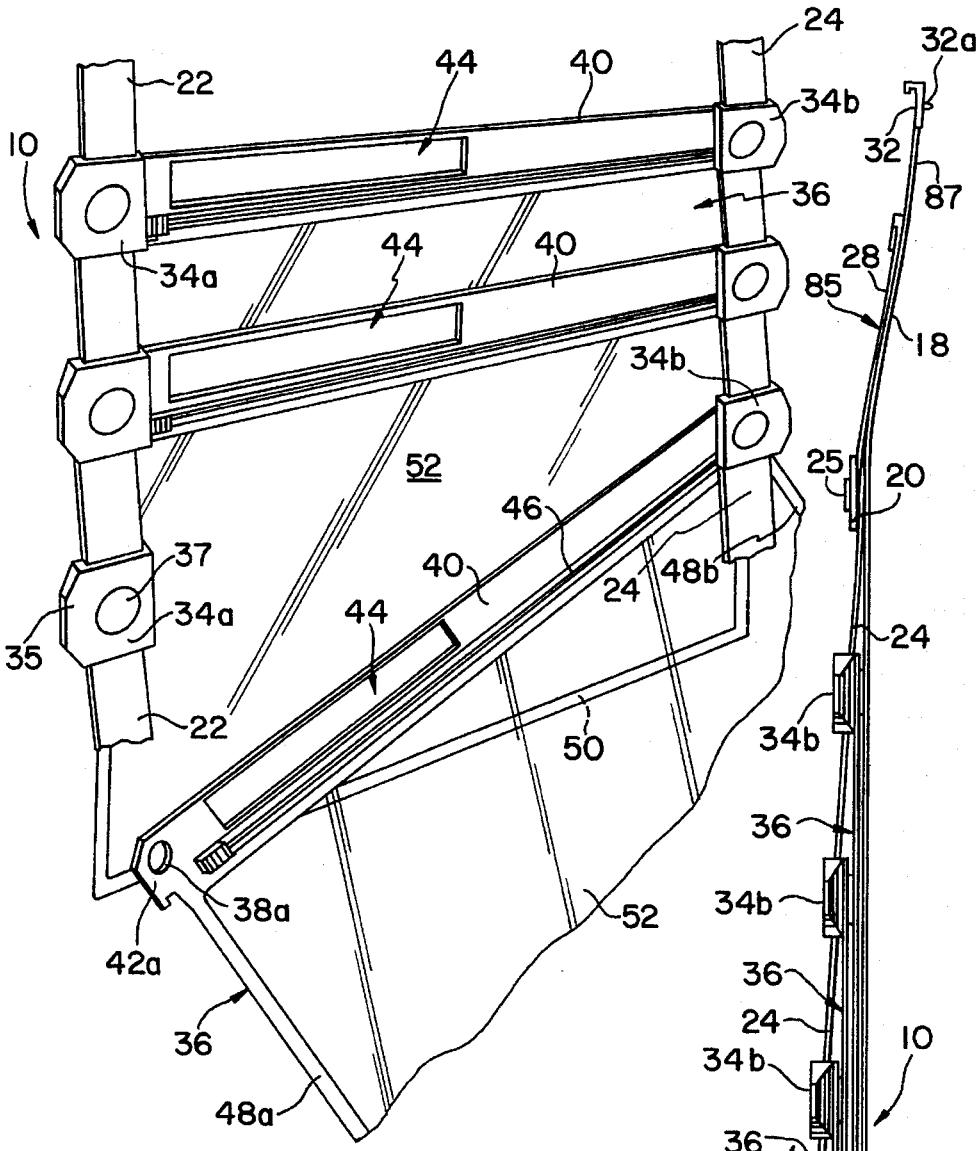
FIG. 4 is an enlarged fragmentary view of a detail in a different position of the embodiment shown in FIG. 1.

Referring now to FIGS. 4 and 6, the pouch 36 is illustrated as being detachably connected to the components 34*a* and 34*b*. In the present embodiment, the snap attachment is in the form of plastic snap fasteners 38*a*, 38*b* defined at each end of the suspension bar 40. The back plate 56 of the component 34 includes a plastic male snap member 58 which is adapted to snap into the female snap component 38*b*, as shown in FIG. 6. The pouches 36 are meant to snap on the rear of the straps 22 and 24, as shown in FIGS. 4 and 5.

Figure 5:
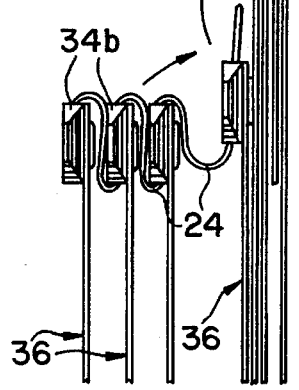
FIG. 5 is a side elevation of the embodiment shown in FIG. 1, with certain elements thereof in different operative positions.

Once the pouch 36, with its relatively stiff construction, that is, including the suspension bar 40 and, in this embodiment, the molded peripheral frame 48, 48*b*, and 50, is connected to the components 34*a* and 34*b* on respective straps 22 and 24, it is an easy matter to close the storage device by grasping a pair of components 34*a* and 34*b* corresponding to a lower pouch 36, i.e., the bottom pouch, as shown in FIG. 5, and lifting the bottom pouch towards the top pouch 36. This action causes the straps 22 and 24 to fold, but for the components 34*a* and 34*b* to retain along with the pouches 36 a parallel relationship such that the flexible portions of the straps 22 and 24 will fold, as shown in FIG. 5, but the components 34*a* and 34*b* and the pouches 36 will stack in a parallel relationship until all of the pouches have been grouped. The bottom wall 14 and the front wall 16 of the case 11 can then be folded into a position as shown in FIG. 2, and the straps 33 closed over the front panel 16. When it is required to open the storage and filing device, the case 11 is hung by means of hook 32 onto a top door edge or rail, and the panels 16 and 14 are allowed to hang from the back panel 12. The pouches 36 will then hang in a staggered manner from the straps 22 and 24 as shown in FIGS. 1 and 4. It is also possible, as shown in FIG. 4, to detach one end of the suspension bar 40 of a pouch 36 from a component 34 which will cause the pouch to swivel from the other attachment at component 34*b*, for instance, to allow more ready access into the pouch 36.

The feature of the hooks 42*a* and 42*b* at the ends of the suspension bar allows the pouch to be placed in a typical filing cabinet, such as a filing cabinet having pairs of tracks for receiving files with hooks provided at the top end corners thereof. Typically, such conventional files have four hanging points when, in fact, the present pouch construction allows a file to be hung from only two hooks 42*a* and 42*b*. It is also understood that the snap fasteners connecting the pouches to the components can be of any conventional construction, such as conventional snap fasteners. Even "Velcro" fasteners could be contemplated in the event of the storage of relatively light material in the pouches.

Although the pouches are contemplated to contain paper sheet material such as usually found in files, it could be utilized for storing photographs and other travelling papers or as a travelling case with various shirts and other clothing in different pouches. Likewise, the pouches can be of sturdy material for storing tools or the like. In such a case, the construction of the straps, components, etc. would be reinforced.

The pouch suspension bar 40 is flexible enough for it to bow, allowing the pouch to open along with the slitted opening 46 for the pouch, into which an opening and closing mechanism such as a slide fastener 37 can be inserted. Alternatively, slide fastener tracks can be formed integrally with the lips of the slitted opening in the suspension bar. The region of the suspension bar below the slot or opening reinforces the front of the pouch when it is opened. The suspension bar could be made of two flat strips and, in fact, the molded peripheral frame can be made in two flat pieces sandwiching the edges of the front and rear panels.

It is envisaged that the suspension bars and/or pouches incorporating suspension bars, will be sold as separate products, which can be used in conjunction with suspension straps, for example, as shown in the drawings, or as closable removable pouches or file folders in otherwise conventional filing systems or in suspension filing systems specifically designed for use with these pouches.

If snap fasteners are provided on the front and rear of the suspension bars as represented by fasteners 38*a*, 38*b*, these front and rear snap components are complementary and can be used to fasten pouches to one another to form a pack of pouches which can be handled as a unit. The pouches may be provided with permanent carrying handles, or detachable handles, e.g., a separate handle with snap fasteners on front and back matching those on the pouch suspension bar.

The ends of the suspension bar project laterally beyond the sides of the pouch and form suspension hooks 42*a*, 42*b* such that the suspension bar and pouch can be suspended on conventional suspension filing supports, for example, in a lateral or vertical suspension filing cabinet.

However, it is to be noted that, in contrast to conventional suspension filing wallets which hang from four support points, the present pouch is suspended from two support points at each end. As a result, it can be suspended from suspension filing support rails which are not necessarily horizontal whereas conventional filing folders cannot.

The described devices have pairs of hanging straps, one at each side. Cords or other flexible or hinged suspension means can be provided. More or fewer suspension means can be provided, for example, a single strap or cord, to which the pouches are attached centrally, or at upper corners of the pouches, with the pouches hanging diagonally.

The straps or other suspension means may be designed to allow the user to adjust the spacing between pouches. For example, a suspension strap may have a multiplicity of suspension points, each of which may be provided with its own snap fastener, at a relatively small pitch, so that the user can attach pouches to it at any selected spacing.

To enable the user quickly to identify the contents of a pouch, a large strip or patch of white or other colour may be printed at the top of each pouch, on which the user can write with a suitable marker, for example, a water-soluble marker. A standard label holder or holders may also be provided, permanently or separably, on the pouches, in particular at the pouch top.

A preferred labelling arrangement is illustrated in FIGS. 7 to 10.

The upper region of the suspension bar 40 is provided with an elongate rectangular recess 62 which may be set into the body of the suspension bar 40 or may be defined by a frame protruding from the front of the suspension bar 40. This recess 62 accommodates a label holder 64 made of semi-rigid plastics or other semi-rigid material. The label holder 64 is a substantially rectangular strip, provided with a projecting tongue 66, 68 of reduced thickness at each end, and a slot 67 between the front and rear walls 69, 71 of the label holder 64. A label 70 of paper, card or other suitable material can be inserted into the slot 67 and is visible through a window 75 in the front wall 69. This window 75 may be a simple aperture or it may be covered by a transparent sheet or layer.

At one end of the label holder 64, its front surface is provided with a thumb grip 72, for example, comprising transverse grooves.

The label holder 64 can be made in any convenient way, for example, as an integral element of extruded or injection moulded plastics material, or by joining together front and rear strips of material to define the slot 67.

The main portion of the label holder between the tongues 66, 68 corresponds in shape and size to the recess 62. At the ends, the recess 61 has undercuts 76, 78 corresponding to the tongues 66, 68. The label holder 64 can, therefore, substantially fill the recess 62 and be held firmly in place by the tongues 66, 68 engaged in the undercuts 76, 78. The stiffness of the label holder 64 ensures that it cannot be accidentally dislodged from the recess.

To insert the label holder 64 in the recess, one end of the label holder 64 is placed in the corresponding end of the recess 62 so that its tongue 66 enters the corresponding undercut 76, and the label holder 64 is bowed slightly so that the tongue 68 at its other end can be inserted into the corresponding undercut 78. Once inserted and allowed to return to its natural flat shape, the label holder 64 is stiff enough to remain in place in the recess 62, held by its tongues 66, 68. Shallow nipples may be provided in the top and bottom side walls of the recess 62, midway along its length, to retain the label holder even more securely.

Figures 7, 8, 9, 10:
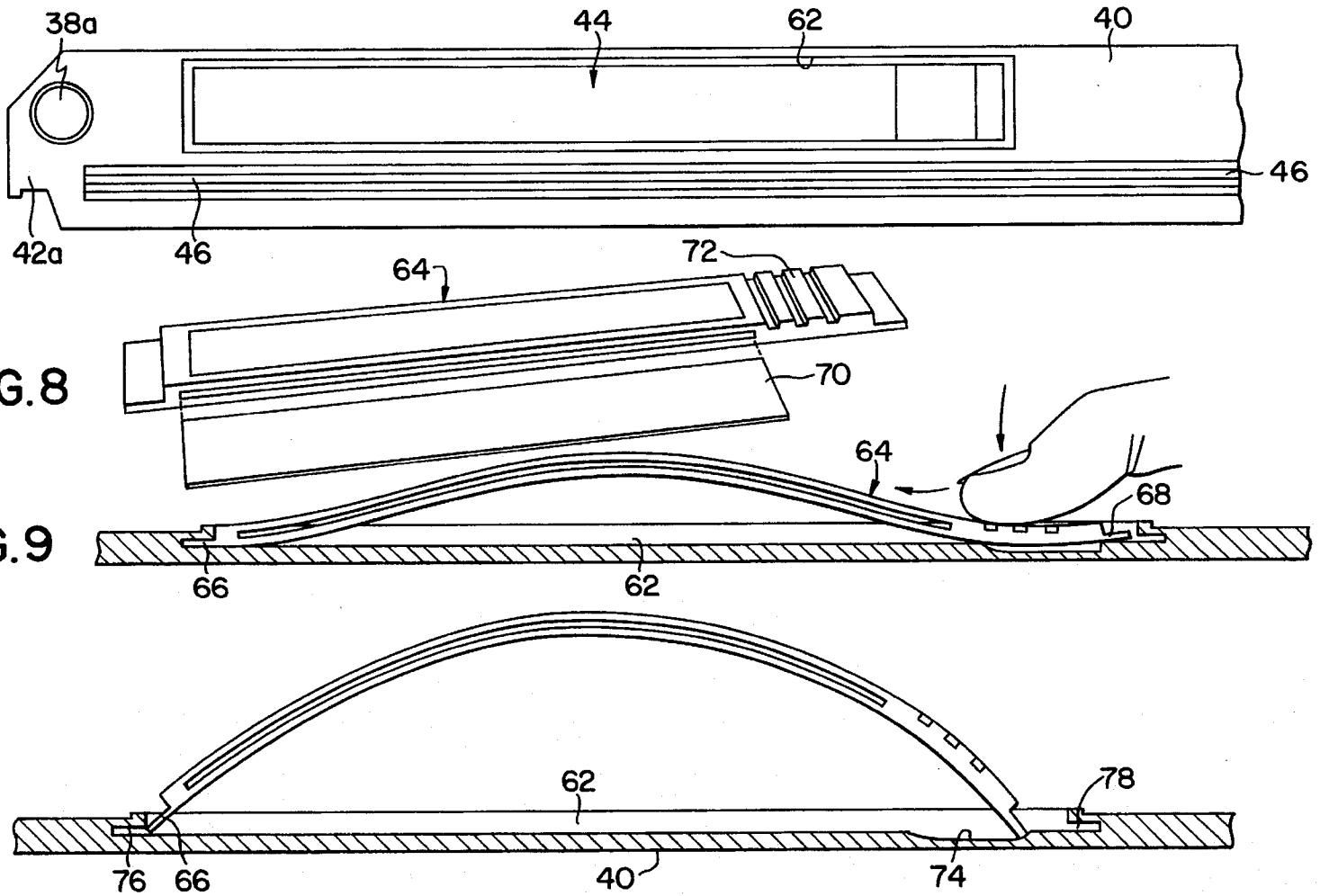
FIG. 7 is an enlarged fragmentary elevation of a detail of the element shown in FIG. 3.
FIG. 8 is a perspective view of a detail shown in FIG. 7.
FIG. 9 is an enlarged fragmentary longitudinal cross-section of a detail shown in FIG. 7 but in a different operative position.
FIG. 10 is a fragmentary enlarged longitudinal cross-sectional view, similar to FIG. 9, showing an element in a still further different operative position.

To remove the label holder, the user pushes the region provided with the thumb grip 72 downward towards the depression 74 in the bottom of the recess, as shown in FIG. 9. This causes the label holder 64 to bow outwards, until the tongue 68 at the thumb grip end 72 of the label holder 64 moves clear of its undercut 78. The label holder 64 can then be lifted or sprung out of the recess 62.

The outer end of the depression 74 may have a sharp step against which the tongue 68 can lodge, once it has moved past this step. This reduces the risk that the label holder may accidentally snap back into the corresponding undercut 78, and makes it easier to manipulate the label holder 64.

The label holder 64 can be coded, for example, by colour or by carrying one or more permanent symbols.

If the label window 75 has a transparent cover, or if the upper layer of the label holder is of transparent material, the transparent material is preferably such that it can be written on, for example, with a felt or dye marker, so that the label holder 64 itself can be used as a label.

The label holder 64 may constitute the sole labelling means, the slot 67 and insertable label 70 being omitted.

In one convenient construction, the label holder 64 comprises a rear layer of semi-rigid plastics material and a front layer of transparent semi-rigid plastics material, the front layer being provided with a border which conceals the edges of the label and defines the window 75.

The label 70, if used, can be made of standard paper of any weight or any other suitable material. The labels themselves can, for example, be provided as tear-off portions of a perforated sheet, in well-known manner.

The described labelling system is extremely simple, reliable and versatile. The label holder can be removed or inserted in the recess using one hand, and the label 70, if used, is automatically inserted or removed with the label holder. Because the label 70 is supported and protected on both sides, it can be made of standard paper of any weight, which is, therefore, easier to type, print or write on than conventional filing system labels which are made of stiff paper or card.

Since the labelling means is an integral part of the pouch, neither the edges of the label nor the end extensions **42*a*, 42*b* at the ends of the suspension bar 40** can damage the bag or other enclosure since they do not have sharp edges contrary to conventional suspension file hooks which are likely to tear any bag type enclosure in which they are placed.

Pouches specially designed to carry films, tapes, computer discs and the like may be provided, and may incorporate protection against damage by security X-rays and the like.

The present invention has numerous applications. For example, with suitable selection of pouch material and size, the device can be used for storing and carrying tools and other equipment. The device can be made of handbag size, or even pocket size, for example, to carry several different currencies and travel documents, passports, airline tickets and the like. In a Larger size, the device can be used to carry and present designer's drawings, fabric samples, photographs and the like; in this embodiment, the pouches may have built-in or removable mounts or frames so that the drawing, fabric or photograph put in the pouch is automatically presented with a frame.

The device can be used for display purposes in shops, exhibit lots and the like, for example, to store and display manuscripts, music, compact discs, stamps, coins, ties, prints, drawings, and so on.

For security, electric or electronic circuitry can be incorporated to provide a signal if a pouch is removed, to provide a theft alarm, or an alert signal to a cashier or other responsible person, and/or to provide inventory control. For example, a conductive path extending along a belt 22, 24 may be broken if a pouch is detached or if the belt is detached, cut, or broken.

Although the pouches preferably have means for fastening them closed, this is not essential. The pouches may be so designed that, at least when detached from the hanging straps, a pouch can be opened out flat like a folder.

FIGS. 1 to 6 illustrate a preferred design of the device with improved pouches and suspension straps. The tops of the straps 22, 24 are attached to a triangular shaped hanger 85 formed by cross bar 20, strips 26 and 28, which is itself attached by a short strap 87 to an attachment means or a hook 32. The flexible strap 87 enables the pouches and their connecting means to swivel or rotate about a vertical axis defined by the longitudinal direction of the strap 87. If strap 87 were rigid, there would be a tendency for the hook 32 to become detached (i.e., dragged off) from its support (not shown) during use of the device. The support may be a rail, the edge of a door or other convenient suspension point.

The triangular shaped hanger 85 comprises a pair of flexible strips on arms 26, 28 which are linked to the strap 87 via a coupling plane 30 so that the strap 87 and arms 26, 28 together form a "Y" configuration. Respective ends of the arms 26, 28 are fixed to respective ends of the main suspension cross bar 20. The main suspension cross bar 20 is sufficiently stiff so that the bar 20 does not deflect outwardly when the pouches are laden. The stiffness can be achieved by reinforcing the bar 20 with steel. The main suspension bar 20 could form the spine of the carrying means. In this case, a carrying handle (not shown) could be attached to the bar 20. The straps 22, 24 of the connecting means are suspended from the ends of the main suspension cross bar 20.

Snap fasteners (not shown) are provided on the reverse side of the main suspension cross bar 20 from that shown in FIG. 1. Complementary snap fastener components (not shown) are provided on the interior of the bag or case for enabling bodily detachment/attachment of the pouches, straps 22, 24, and hanger 85 from/to the bag or case. The hook 32 may have a snap fastener component 32*a* on its front so that it can be attached to a corresponding snap fastener component 32*b* provided in the bag or case, to keep the hook safe and tidy.

Finger impressions or other markings may be moulded into the triangular hanger 85 and the components 34, on their front surfaces, to indicate the positions of the snap fasteners on the rear.

The snap fasteners on the rear of the main suspension cross bar 20 can also be used to attach the hanger 85 to a board or panel provided with complementary snaps.

Snap fasteners 25, which are preferably non-circular in profile to prevent the straps 22, 24 from swivelling outwards when the pouches are gathered in a stack may optionally be provided for attaching the straps 22, 24 to the hanger 85. The straps 22, 24 in this embodiment are flexibly attached to the hanger 85.

The hook 32 incorporates a slot 35 which facilitates moulding of the hook, and in addition can be used for hanging on nails and the like.

The arms 26, 28 of the hanger 85 may have, in cross-section, thicker edge regions and a thinner intermediate region, to enable them to flex. Alternatively, they may be formed from a woven material.

FIGS. 11 to 14 illustrate an alternative embodiment with a modified pouch constructions and a modified form of attachment to the flexible support straps.

Figure 11:
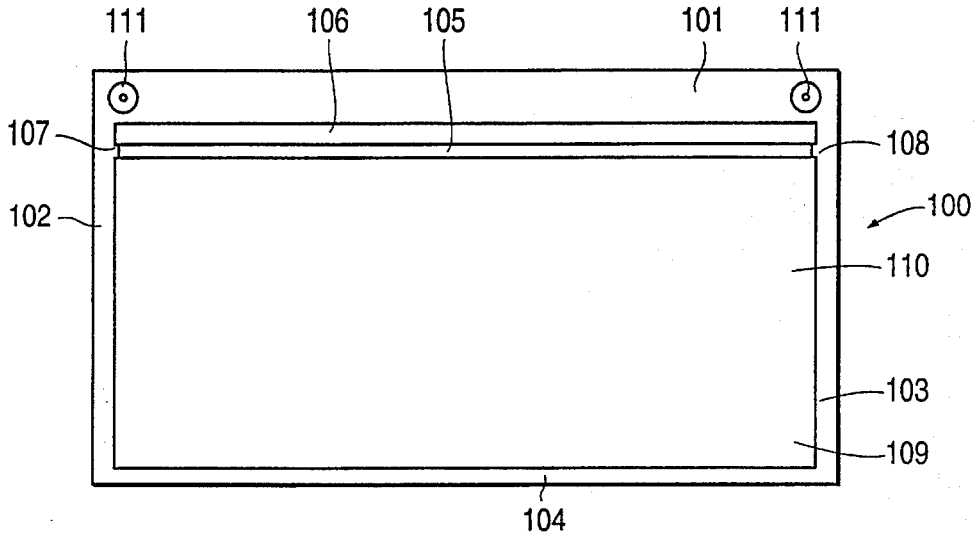
FIG. 11 is a view of another embodiment of the invention pouch.

The pouch 100 comprises a one piece moulded frame of semi rigid plastics, which is essentially self supporting but flexible in various directions. The frame comprises an upper cross member 101, two downwardly extending side members 102 and 103 and a lower cross member 104. A short distance below the upper cross member 101 is a stiffener 105 extending between the side members 102 and 103. The space 106 between upper cross member 101 and stiffener 105 will provide access to the interior of the pouch. In this embodiment it is open but it could be provided with a zipper or other fastener. The stiffener 105 will be bent to assist access to the interior of the pouch, and to assist in this it has portions at either end, 107, 108, where it forms the side members, which are of reduced depth. These act as hinges to assist deflection of stiffener 105 relative to the side members 102, 103. The members are otherwise of substantially equal depth but as shown in FIG. 11 the side members 102, 103 and lower cross member are of substantially the same width; the stiffener 105 is less wide; and the upper cross member is wider. For the purposes of this discussion the width refers to the width relative to the longitudinal directions of each member and the depth refers to the depth perpendicular to the plane of the drawing in FIG. 11.

The main part of the pouch is completed by two layers of flexible film material, such as a clear plastics film, 109, 110 although these could be two portions of a single sheet folded along its lower edge.

The first layer 109 is bonded to the rear of the frame as viewed in FIG. 11, along the lower cross member 104, the stiffener 105, and the side members 102, 103 up as far as the stiffener. This sheet does not project beyond the space 106. The second layer is bonded—over the first sheet as necessary—to the upper and lower cross members 101, 104, and to the side members 102, 103. It is not bonded to the stiffener 105.

There is thus provided a pouch between the two layers 109, 110, which is essentially sealed around its edges, but into which access is possible through the space 106.

Figure 12:
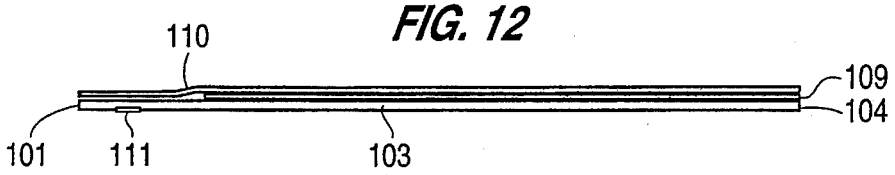
FIG. 12 is a side view of the pouch of FIG. 11.

FIG. 12 is a view from the side, with the front of the pouch facing down, showing the arrangement of the layers 109, 110 on the frame.

To gain access, the upper cross member 101 and the stiffener 105 are moved apart relative to each other. Each will tend to bow against the natural resilience of the material, so as to provide an opening defined by two outwardly directed curves. As this happens the side members move together at their upper ends. The arrangement permits very significant expansion of the pouch, but this expansion differs substantially from that provided by conventional suspension files or gusseted folders.

The resilience of the frame material provides a force tending to close the opening and to urge the film layers onto any contents placed in the pouch. There is a generally even distribution of pressure within the pouch, between the layers.

There is thus provided a pouch which is thin when empty (the thickness of the film layers being exaggerated in FIG. 12) but which can expand to accommodate substantial thicknesses of contents.

The semi-rigid nature of the frame makes the pouch self supporting and it can be used in place of conventional files, folders and so forth, either in drawers or resting on a desk and so forth.

In this embodiment, however, the pouch is adapted to form part of a suspended storage/filing device of the general type discussed earlier. Thus, at either end of the upper cross member 101 there are provided snaps 111 which are adapted to cooperate with snaps on support members on either side of the pouch. The snaps 111 are female in nature and are recessed in the upper cross member so as to be substantially flush on each side.

Figure 14:
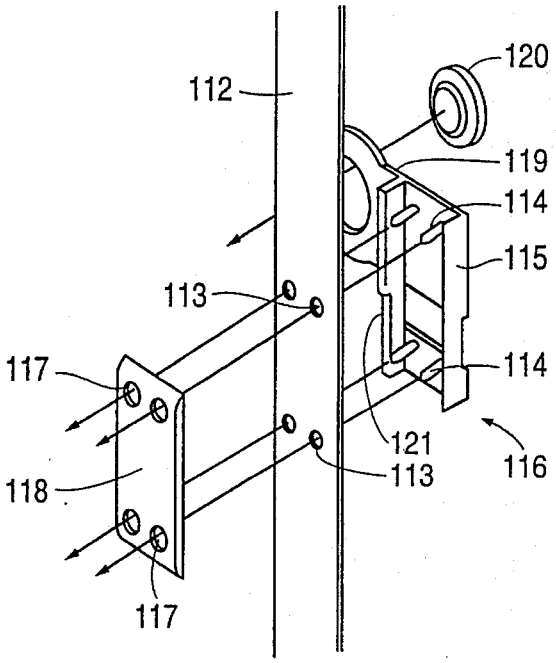
FIG. 14 is an exploded view of a connection piece.

FIG. 14 shows in exploded form a connection piece, snap and flexible support member for attachment to the pouch. Of course, one will be used on each side of the pouch.

The flexible support member 112 is of a suitable strong material such as a webbing strap. It is provided with four apertures 113 through which extend lugs 114 on a front portion 115 of the connection piece 116. These lugs engage in apertures 117 on a rear portion 118 of the member 112, and are held in place by a snap fit adhesive, or the like. Thus the connection piece 116 is firmly affixed to the flexible support member 112.

Figure 13:
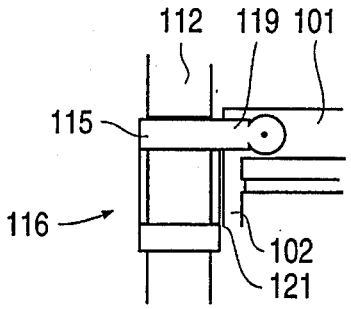
FIG. 13 is a view of a connection piece.

The front portion 115 has an inwardly directed extension 119 into which is embedded a male snap 120. In use, the snap 120 engages the female snap 111 on the pouch, so as to attached the pouch to the support member 112 as shown in FIG. 13. Thus, in practice the pouch will be supported on both sides by appropriate members 112 and connection pieces 116.

The snaps 111 and 120 permit relative axial rotation. This can be useful when engaging and disengaging the snaps, for example to remove or replace the pouch. However, there may be instances when it is preferred to have a more stable arrangement. Accordingly, connection piece 116 is provided with an inwardly facing, vertically extending face 121. This is arranged to engage the side of the side member 102, this restricting relative pivotal movement between the pouch and the support member 112 in one direction, and providing a stable structure when there is vertical orientation of the pouch. Rotation in the opposite direction is possible, to assist in detaching the pouch from the connection piece. The rigid connection piece 116 is relatively easy to snap off from a pouch when desired.

An advantage of such an arrangement is that the support straps 112 are situated completely beyond the sides of the pouch. Thus, when the arrangement is closed up with several pouches pushed together in a concertina fashion, there will not be a thickness of strap—and any connection piece—squeezed between two adjacent pouches as in the previous embodiment (see FIG. 5 for example). This leads to a more compact arrangement.

The flexible support strap 112 is continuous, but it could be a number of lengths joined together. Furthermore, the strap arrangement could be replaced by a hinge system, in which adjacent pouches are joined together by the hingedly connected rigid or semi rigid portions. However, the use of a rigid hinge system has disadvantages. There would be greater difficulty in snapping pouches on and off; the system would not close up so easily; and the whole system could be more rigid, less easy to handle, and susceptible to breakage.

This alternative embodiment of pouch and of method of attachment to the support straps, described with reference to FIGS. 11 to 14 is advantageous in many respects and the pouches are useful on their own. Indeed pouches without any snaps could be used as stand alone files, or the pouches could be provided with portions for use as a suspended file system. The invention is not limited to a portable type of system with a number of pouches.

It would also be possible to have a system with only one support strap, at one side of the pouches. In such an arrangement it is to be expected that the pouches would hang downwardly at an angle.

What is claimed is:

1. A storage pouch comprising:

(a) a semi-rigid frame having an upper cross member having two ends, a lower cross member, a pair of side members extending between and joining the upper and lower cross members, and a stiffener extending laterally between and connected to the side members, the stiffener being spaced downwardly from the upper cross member by a relatively short distance, (b) a first flexible sheet portion attached to the frame and covering an area defined between the stiffener, the lower cross member and the pair of side members, and (c) a second flexible sheet portion attached to the frame and covering an area defined between the upper cross member, the lower cross member and the pair of side members, wherein a pouch space is provided between the first and second sheet portions and access to said pouch space is permitted through an opening defined by the space between the upper cross member and the stiffener, and wherein at least the stiffener is capable of bending resiliently to increase the size of the opening, and wherein the stiffener is connected to at least one of the side members by a reduced portion to assist movement of the stiffener relative to the side portion.

2. A pouch according to claim 1, wherein at least the upper cross member and the pair of side members are also capable of bending resiliently.

3. A pouch according to claim 2, wherein the frame is molded in one piece from a semi-rigid and resiliently bendable plastic material.

4. A pouch according to claim 3, wherein the first and second sheet portions are of plastic film bonded to the frame.

5. A pouch according to claim 4, wherein the first and second sheet portions are bonded to the frame on the same side thereof.

6. A pouch according to claim 1, wherein the upper cross member and the stiffener are bendable in opposite directions to provide access to the interior of the pouch.

7. A pouch according to claim 1, wherein the opening is provided with a longitudinally extending closure device which can be selectively opened and closed so as to permit or prevent access to the interior of the pouch.

8. A pouch according to claim 1, wherein at each end of the upper cross member there is provided means for attaching the pouch to a support member or suspension device.

9. A pouch according to claim 1, wherein the fastener is in the form of a snap fastener portion recessed in the frame so as to be substantially flush with the outer surfaces thereof.

10. A pouch according to claim 1, further in combination with a pair of longitudinally extending support members for the pouch, wherein (a) each support member has a fastener portion releasably engagable with a respective fastener portion on the pouch, and (b) at each end of the upper cross member of the pouch there is provided a fastener portion for releasable engagement with a respective fastener portion on the support members.

11. A pouch according to claim 10, wherein (a) each support member is positioned laterally outwardly of a respective side of the pouch, and (b) the respective fastener portion on the support member has a connection piece which projects laterally from the support member to the respective fastener portion on the pouch.

12. A pouch according to claim 11, wherein engagement between a fastener portion on the pouch and a fastener portion on a connection piece is such as to permit relative rotation, and wherein the connection piece has a portion arranged to abut against a side member of the pouch to restrict such rotation in one direction.

13. A pouch according to claim 10, wherein (a) each support member is a flexible strap, and (b) each fastener portion of the support member having a connection piece is a rigid member attached to the strap.

14. A storage pouch according to claim 1, wherein at each end of the upper cross member there is provided an outwardly facing hook adapted to engage file suspension tracks.

15. A storage pouch according to claim 1, wherein a label holder is provided on the upper cross member.

16. A pouch according to claim 1, wherein the stiffener is connected to at least one of the side members by a reduced portion to assist movement of the stiffener relative to the side portion.

* * * * *